United States Patent [19]

Kikuchi et al.

[11] Patent Number: 4,722,623

[45] Date of Patent: Feb. 2, 1988

[54] PRINTER AND PAPER INSERTION DEVICE SUITABLE THEREFOR

[75] Inventors: Hiroshi Kikuchi; Shyoichi Watanabe; Yukio Ota; Yoshinori Koshida; Takashi Itaya; Jiro Tanuma, all of Tokyo, Japan

[73] Assignee: Oki Electric Industry Co., Ltd., Tokyo, Japan

[21] Appl. No.: 836,513

[22] Filed: Mar. 5, 1986

[30] Foreign Application Priority Data

Mar. 9, 1985 [JP] Japan ..... 60-32863[U]
Mar. 9, 1985 [JP] Japan ..... 60-32864[U]

[51] Int. Cl.[4] ..... B41J 15/04

[52] U.S. Cl. ..... 400/607; 400/611; 400/624; 400/634; 400/642; 400/616.2

[58] Field of Search ..... 400/599, 603, 605, 616.3, 400/607, 611, 624, 634, 636, 637, 639, 642, 616

[56] References Cited

U.S. PATENT DOCUMENTS

| | | | |
|---|---|---|---|
| 1,432,696 | 10/1922 | Helmond | 400/603 X |
| 2,586,522 | 2/1952 | Dobson | 400/607 X |
| 4,133,613 | 1/1979 | Webster | 400/616.3 |
| 4,164,376 | 8/1979 | Yarp | 400/603 X |
| 4,229,113 | 10/1980 | Anderson et al. . | |
| 4,569,610 | 2/1986 | Drejza et al. . | |
| 4,579,471 | 4/1986 | Hendrischk | 400/605 |

FOREIGN PATENT DOCUMENTS

| | | | |
|---|---|---|---|
| 113701 | 7/1984 | European Pat. Off. | 400/607 |
| 143374 | 6/1985 | European Pat. Off. | 400/607 |
| 166132 | 1/1986 | European Pat. Off. | 400/607 |
| 187282 | 11/1982 | Japan | 400/605 |
| 8678 | 1/1983 | Japan | 400/616.3 |
| 203024 | 11/1983 | Japan | 400/605 |
| 8203823 | 11/1982 | PCT Int'l Appl. | 400/605 |

*Primary Examiner*—Charles A. Pearson
*Assistant Examiner*—James R. McDaniel
*Attorney, Agent, or Firm*—Wenderoth, Lind & Ponack

[57] ABSTRACT

A printer comprises a first paper feed passage extending from the rear of a platen to a printing position through the lower part of the platen, and a second paper feed passage extending from substantially just under the printing position to the printing position. A first pinch roller is disposed on the way to the first paper feed passage for pressing a first paper against the platen. The first paper is fed by rotating the platen. A second pinch roller is disposed on the way to the second paper feed passage for pressing the second paper against the platen. Rotation of the platen here causes the second paper to be fed. In addition, a paper insertion device according to the present invention includes a flat part for placing a paper thereon and a slit for converting the advance direction of a paper from horizontal to vertical. With the second paper placed on the flat part and inserted into the printer, the paper is directed upward after the curved surface of the slit and allowed to enter the second paper feed passage with ease for further advance.

6 Claims, 8 Drawing Figures

PRINTER AND PAPER INSERTION DEVICE SUITABLE THEREFOR

BACKGROUND OF THE INVENTION

1. Field of the Invention

The present invention relates to a printer capable of setting a second paper therein and keeping a first paper in its set state and of printing any data on the newly set paper, and furthermore to a paper insertion apparatus suitable for the printer.

2. Description of the Prior Art

A printer of this type is disclosed in, for example, Japanese Patent Application No. 58-31313 U.S. Pat. No. 4,229,113. The printer is capable of treating different types of documents such, for example, as receipt tapes, etc., for monetary transactions, scrips and multipart documents for relatively complicated businesses such as taxation and sales, etc. The apparatus has a first receipt tape feed passage for guiding a receipt tape delivered from a supply roll housed in the apparatus to a printing part, and a second scrip feed passage for guiding a scrip inserted by an operator from the front of the apparatus to the printing part. The apparatus can print data about monetary transactions on a receipt tape guided through the first receipt tape feed passage and put a scrip inserted from the outside on the receipt tape and print any data about taxation and sales, etc., on the scrip.

The device can feed a paper between a pinch roller and a platen provided upward of the printing part, and with the paper pressed by the pinch roller, move the paper by rotation of the platen.

However, such a prior printer as described above suffers from a disadvantage that, upon guiding a paper inserted from the upper part to a pinch roller provided upward, the paper may be caught on a ribbon guide and a ribbon protector included in the printing part, and thus it is difficult to set the paper. In addition, a guide part for inserting a scrip cannot keep a paper therein since it merely comprises a horn type cavity and does not position the paper in place.

Moreover, the apparatus is made thicker by a space corresponding to a passage needed to insert the scrip. As a result, the apparatus is unsuitable for desktop use or it must have a hole made in a table for allowing the paper to pass therethrough.

SUMMARY OF THE INVENTION

In view of the drawbacks of the prior printer, it is an object of the present invention to provide a printer capable of smoothly setting paper without being caught on the printing part thereof.

Another object of the present invention is to provide a paper insertion device capable of placing a second paper thereon with accurate positioning of the paper and guiding the paper to the second feed passage.

Still another object of the present invention is to provide a printer provided with a paper insertion device, the printer being made thinner upon employing a paper of one kind, and being capable of simultaneously setting two types of papers and printing any data on the upper paper.

To achieve the above objects, a printer according to the present invention has a first paper feed passage extending from the back of a platen through the lower portion thereof to a printing portion, and a second paper feed passage extending from a portion substantially directly below the printing portion almost to the printing portion. The printer includes a first pinch roller disposed on the way to the first paper feed passage for bringing a first paper into close contact with the platen, the first paper being fed by rotation of the platen, and further includes a second pinch roller on the way to the second paper feed passage for pressing a second paper against the platen, the second paper being fed by rotation of the platen. A paper insertion device according to the present invention has a flat section for placing paper thereon as well as a slit for changing the advance direction of the paper from horizontal to vertical.

When the second paper is placed in the flat section and inserted into the printer, the paper goes upward along the curved surface of the slit and enters the second paper feed passage with ease for further advance.

The above and other objects, features and advantages of the present invention will become more apparent from the following description when taken in conjunction with the accompanying drawings in which preferred embodiments of the present invention are shown by way of illustrative examples.

DETAIL DESCRIPTION OF THE PREFERRED EMBODIMENTS

Figure 1:
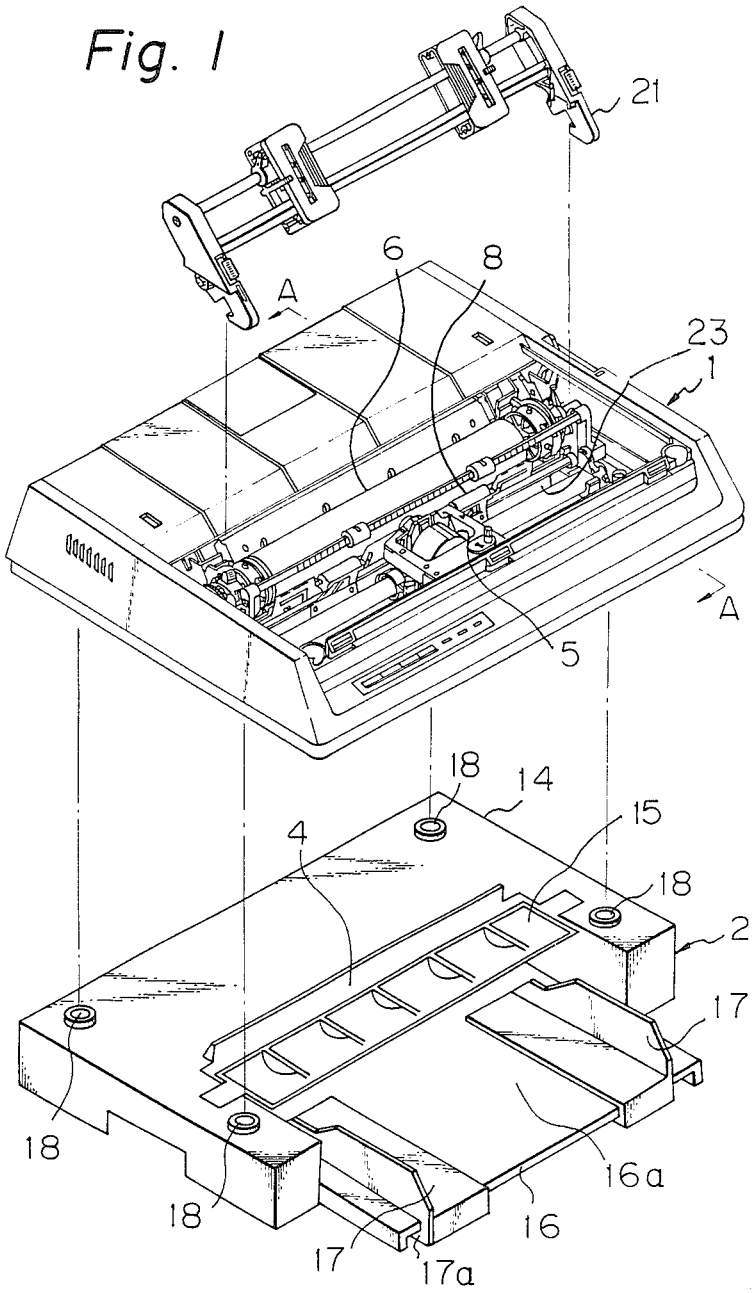
FIG. 1 is an exploded perspective view illustrating an embodiment of a printer and a paper insertion device suitable therefor according to the present invention.

As shown in FIG. 1, a printer according to the present invention comprises a printing unit 1 and a paper insertion unit 2, and with them in use the paper insertion unit is placed on a desk, and the printing unit 1 placed thereon.

Figure 2:
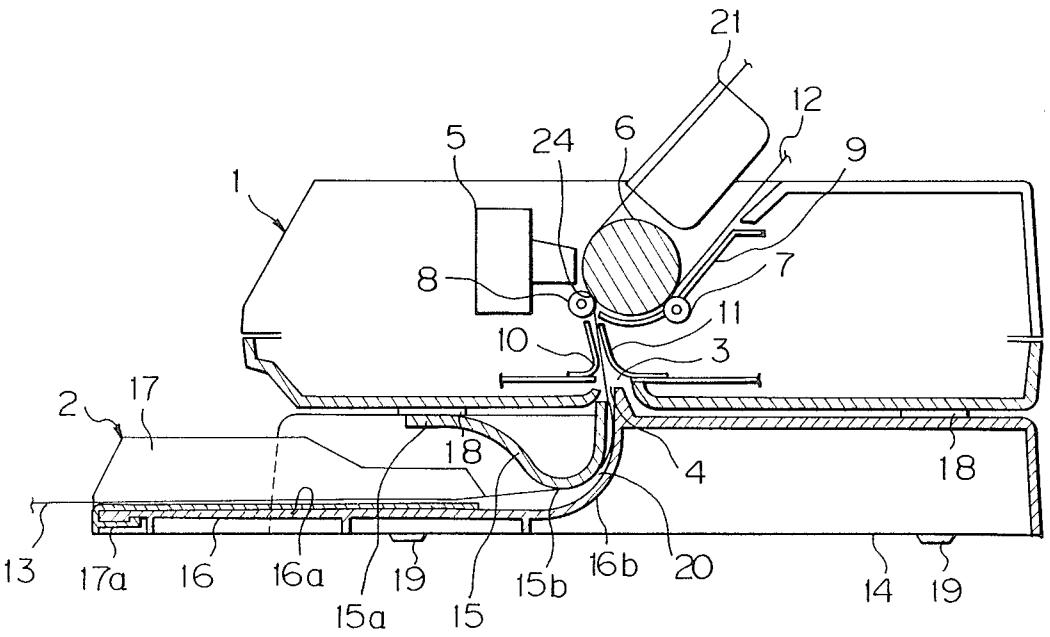
FIG. 2 is a side cross-sectional view showing a structure, when cut away in an A—A plane, of the embodiment of FIG. 1.
Figure 3:
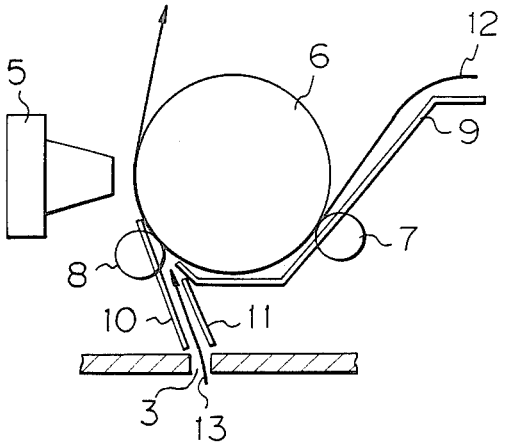
FIG. 3 is a schematical side elevational view of a portion of the embodiment of FIG. 1 illustrating a process of setting two types of paper.

In FIG. 2 illustrating, a side cross-sectional view, the printer in use, details of the printer are neglected for brevity. Two types of papers are allowed to advance in the direction of arrows shown in FIG. 3. As shown in FIGS. 1, 2 and 3, the printer has an opening 3 formed in the central lower part of the printing unit 1, and an opening 4 corresponding to the opening 3 and formed in the central upper part of the paper insertion unit 2. The opening 3 facing the opening 4 partly forms a paper feed passage. The printing unit 1 includes a printing head 5, a platen 6, pinch rollers 7, 8, paper guides 9, 10, 11, and a tractor 21. The paper guide 9 extends from the platen 6 to the lower part thereof, and further along the outer peripheral surface of the platen 6 to the front thereof, and forms a first paper feed passage through which a continuous paper 12 passes, jointly with the platen 6. The pinch roller 7 is located on the way to the first paper feed passage, and presses the continuous paper 12 against the platen 6 at a position backward from just under the platen. The paper guides 10, 11 extend from the opening 3 to a position where a printing head 5 and the platen 6 face each other, i.e., to a printing position upward, and the pinch rollers 8 are located on the way to a second paper feed passage for pressing a scrip 13 against the platen 6 between the tips of the paper guides 10, 11 and the printing position. The paper insertion unit 2 includes a frame 14 for supporting the printing unit 1, an upper guide plate 15, a lower guide plate 16, and side guides 17. The frame 14 has guide holes 18 to permit support legs of the printing unit 1 to be inserted in the upper four corners thereof, and rubber-made legs 19 are mounted on the bottom at positions substantially corresponding to the four corners. The upper guide plate 15 has an upper wall 15*a* suspended from the upper surfaee of the frame 14 and a crook part 15*b* extending upward from the lowest portion of the upper wall 15*a*. The lower guide plate 16 has a flat part 16*a* for supporting a scrip 13 and a crook part 16*b* extending upward from the rear of the flat part. The side guide plates 17 are mounted on the front end of the lower guide plate 16 by edges 17*a* supported movably widthwise of the paper. A slit 20 is formed by the crook part 15*b* of the upper guide plate 15 and the crook part 16*b* of the lower guide plate 16, and the scrip 13 is guided to the opening 3 of the printing unit 1 through the slit 20.

A continuous paper 12 is typically employed in the embodiment with the above arrangement according to the present invention. The continuous paper 12 is intermittently fed by tractor 21 inserted from the rear of the printing unit 1 and allowed to advance in the first paper feed passage. The continuous paper is printed thereon with prescribed data at a prescribed position, and again fed by means of the tractor 21 after completing the printing along one line of the paper.

Now, printing any information on the scrip 13 after completing the printing on the continuous paper 12 or interrupting the printing on the continuous paper 12 at need is effected as follows: First, a scrip 13 is placed on the flat part 16*a* of the lower guide plate 16 and forced to advance along the side guides 17. A scrip 13 of a different size may also be employed or may be transversely displaced in its set position at need by moving the side guides 17. With the scrip 13 so advanced, the scrip 13 moves its tip on the crook part 16*b* of the lower guide plate 16, and is guided to the slit 20 while being maintained down by the upper guide plate 15. The scrip is further forced to advance through the slit 20, the opening 4 in the paper insertion unit 2, and the opening 3 in the printing unit 1, and further is forced to pass between the paper guides 10, 11, i.e. through the second feed passage, and strikes a contact part 24 between the pinch roller 8 and the platen 6. The platen 6 is rotated in this state. Hereby, the scrip 13 is forced to advance upward together with the continuous paper 12 following rotation of the platen 6 while being pressed against the platen 6 by means of the pinch roller 8. The scrip 13 has then been put on the continuous paper 12. After stopping the rotation of the platen 6 at a proper position, printing is started. Once printing over one line is completed, the platen 6 is rotated to force the scrip 13 and the continuous paper 12 to be again advanced. After printing necessary data in such a way, the platen 6 is further rotated to force the scrip 13 to a position where it is out of the contact with the pinch roller 8. With this operation, the scrip 13 is discharged. Thereafter, the next scrip may be inserted or printed thereon if necessary, or the continuous paper 12 may be printed thereon.

Figure 4:
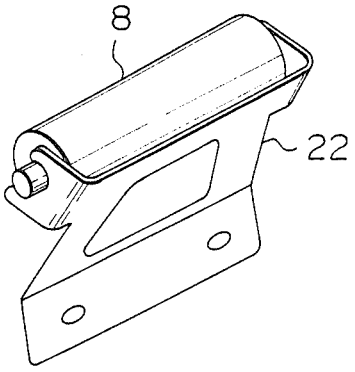
FIG. 4 is a perspective view showing a pinch roller and a support therefor for use in the embodiment of FIG. 1.

Hereupon, provided the platen 6 is rotated to advance the scrip 13, the continuous paper 12 is also advanced in conformity with the rotation of the platen 6, but there is in sag on the continuous paper 12 since the paper tractor 21 is driven in synchronism with the platen 6. This is achieved by mounting a gear on a shaft of the platen 6 and rotating the shaft of the tractor 21 via a gear engaging with the above gear. In addition, the pinch roller 8 is supported by a frame 22 formed by a spring and shaped as shown in FIG. 4 and thereby the pinch roller 8 is pressed toward the platen 6. The frame 22 is mounted on a beam 23 of FIG. 1.

Figure 5:
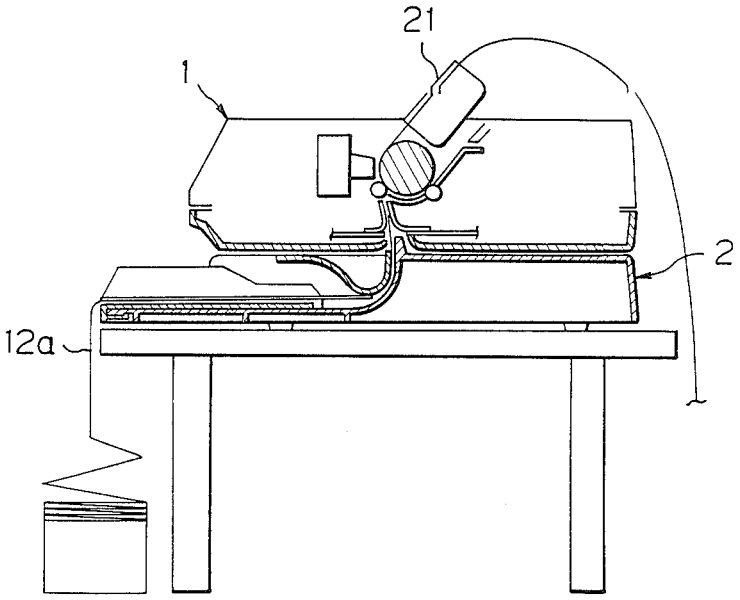
FIG. 5 is a side cross-sectional view exemplarily illustrating another application of the embodiment of FIG. 1.

Although in the above description, the printer according to the present invention is described as being typically capable of printing any data on a scrip or a continuous paper at need, it is also possible to permit the continuous paper 12*a* to be inserted therein from the paper insertion unit 2 and the paper to be advanced by means of the tractor 21 as shown in FIG. 5. There is no fear that perforations in a continuous paper before printing will be caught by those in same paper after the printing and thereby that the latter paper again will be drawn into the paper feed passage, since the continuous paper 12 does not take a U-turn in this case.

Figure 6:
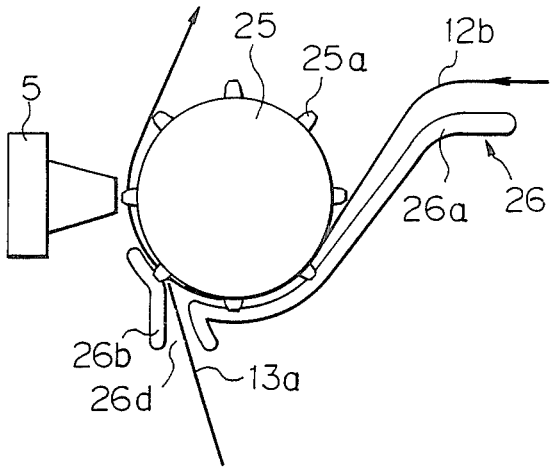
FIG. 6 is a schematical side elevational view of a portion of the embodiment of FIG. 1 showing a state wherein a sprocket wheel is employed.
Figure 7:
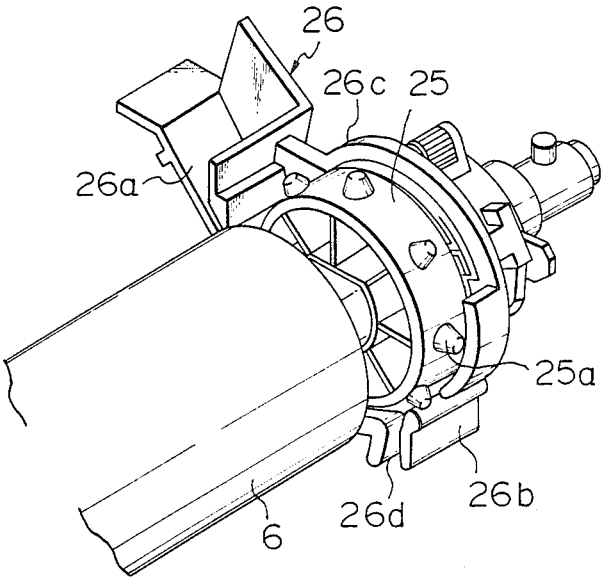
FIG. 7 is a perspective view illustrating a guide frame provided in the vicinity of the sprocket wheel of FIG. 6.
Figure 8:
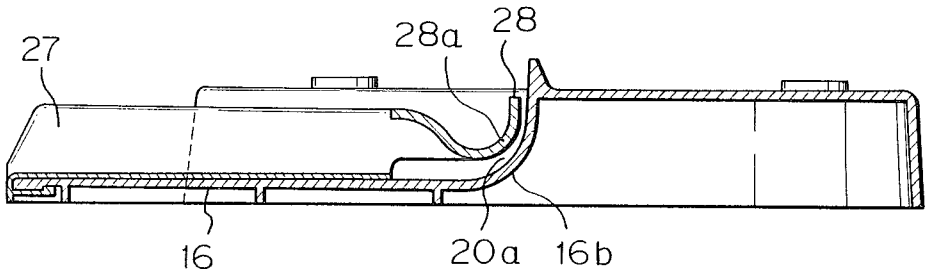
FIG. 8 is a side cross-sectional view illustrating another embodiment of the paper insertion device according to the present invention.

In the case where continuous paper 12*b* having sprocket holes therein and a scrip or continuous paper 13*a* with sprocket holes having the same width as that of the continuous paper 13*a* are employed, as shown in FIG. 6, the tractor 21 of FIG. 1 is removed and a sprocket wheel 25 mounted on both ends of the platen shaft is employed instead of the tractor 21. One paper 12*b* passes through the first feed passage while the other paper 13*a* passes through the second paper feed passage, and they are fed in an overlapping relation. A pin 25*a* of the sprocket wheel 25 penetrates sprocket holes in each paper. In the present embodiment, formation of the first and second paper feed passages also in the vicinity of the sprocket wheel 25 facilitates setting of any paper. For this, also in the present embodidment, an integral guide frame 26 is mounted on the shaft of the platen as shown in FIG. 7. The guide frame 26 has a main guide 26*a*, a subguide 26*b*, and a side plate 26*c*, and an opening 26*d* is formed in a gap between the main guide 26*a* and the sub-guide 26*b*. In addition, although the paper insertion unit employs separately the upper guide plate and the side guide, a slit 20*a* may be formed by forming the upper guide part 28 having a proper width on the tip of the side guide 27 as shown in FIG. 8 and making use of a crook part 28*a* of the upper guide part 28 and a crook part 16*b* of the lower guide plate 16.

Although certain preferred embodiments have been shown and described, it should be understood that many changes and modifications may be made therein without departing from the scope of the appended claims.

What is claimed is:

1. A printer for printing on continuous and sheet paper, comprising:

a cylindrical platen;

a driving mechanism for rotating said platen in a rotational direction from a rear portion of said platen to a front position of said platen via a lower portion of said platen;

a first paper feed passage extending from said rear portion of said platen to a printing position at said front portion of said platen via said lower portion of said platen, for guiding a first paper from said rear portion of the platen to the printing position at said front portion of the platen via said lower portion of the platen;

a second paper feed passage extending from just under the printing position to the printing position, for guiding a second paper from substantially just under the printing position to the printing position;

a first pinch roller disposed at an intersection between the first paper feed passage and said rear portion of said platen for pressing the first paper against the platen prior to reaching said printing position;

a second pinch roller disposed at an intersection between the second paper feed passage and said lower portion of said platen for pressing the second paper against the platen prior to reaching said printing position;

feeding means, at one of above said printing position and on both axial ends of said platen, and engagable with sprocket holes in whichever of the first and second paper that is continuous paper, for feeding, the continuous paper past the printing position; and a printing head for printing data on the paper fed to the printing position.

2. A printer according to claim 1, wherein said feeding means comprises sprocket wheels mounted on both axial ends of said platen and rotated in synchronism with the platen.

3. A printer according to claim 2, wherein said first and second paper feeding passages comprise guide frames mounted at the radial periphery of said sprocket wheels.

4. A printer comprising:

(a) a printing unit including:

a cylindrical platen;

a driving mechanism for rotating the platen;

a first paper feed passage for guiding a first paper from the rear of the platen to a printing position at the front of the platen via the lower part of the platen;

a second paper feed passage for guiding the second paper from a printing unit opening formed substantially just under the printing position to the printing position;

a first pinch roller disposed at an intersection between the second paper feed passage and the lower part of the platen for pressing the second paper against the lower part of the platen; and a printing head for printing any character on the paper fed to the printing position, said printer further comprising:

(b) a paper insertion unit including:

an insertion unit opening formed at a position facing said printing unit opening for allowing the paper to pass therethrough;

a flat part for supporting the paper thereon; and a curved slit for guiding the paper from the flat part to said insertion unit opening, said printing unit being mounted on said paper insertion unit.

5. A printer as in claim 1, wherein said feeding means comprises a tractor disposed above said printing position.

6. A paper insertion device comprising:

a frame including means for supporting a printer on an exposed supporting upper surface thereof;

an opening formed at substantially the center of said upper surface for allowing paper to be printed upon to pass therethrough;

a lower guide plate having an upper surface forming flat means for supporting thereon the paper, sand lower guide plate having a front end;

means defining a curved slit for guiding the paper from said flat means to said opening in said supporting upper surface of said frame; and a side guide plate having a flexible edge bent around said front end of said lower guide plate and movable along said front end widthwise of the paper and perpendicularly to the direction of movement of the paper from said flat means toward said curved slit.

* * * * *